US010416589B2

(12) United States Patent
Kobori

(10) Patent No.: US 10,416,589 B2
(45) Date of Patent: Sep. 17, 2019

(54) IMAGE FORMING APPARATUS AND METHOD OF CONTROLLING IMAGE FORMING APPARATUS

(71) Applicant: KONICA MINOLTA, INC., Tokyo (JP)

(72) Inventor: Kazuki Kobori, Toyokawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 16/121,092

(22) Filed: Sep. 4, 2018

(65) Prior Publication Data

US 2019/0086830 A1 Mar. 21, 2019

(30) Foreign Application Priority Data

Sep. 21, 2017 (JP) ..... 2017-181268

(51) Int. Cl.
*G03G 15/02* (2006.01)

(52) U.S. Cl.
CPC ..... *G03G 15/0266* (2013.01)

(58) Field of Classification Search
CPC ..... G03G 15/0266; G03G 15/0233; G03G 15/0216; G03G 2215/021
See application file for complete search history.

(56) References Cited

U.S. PATENT DOCUMENTS 5,420,671 A * 5/1995 Kisu ..... G03G 15/0216 399/174
5,966,558 A * 10/1999 Kikui ..... G03G 15/0266 399/44
2008/0044194 A1* 2/2008 Miyaji ..... G03G 15/0266 399/50

FOREIGN PATENT DOCUMENTS

JP 2002182455 A 6/2002

* cited by examiner

*Primary Examiner* — Sandra Brase
(74) *Attorney, Agent, or Firm* — Buchanan Ingersoll & Rooney PC

(57) ABSTRACT

An image forming apparatus includes: a photoreceptor having a photosensitive layer formed on a surface; a charging device that electrically charges the surface of the photoreceptor through electric discharge between the charging device and the photoreceptor; and a hardware processor that: calculates a peak-to-peak voltage to be applied to the charging device, using a measured value of a relative dielectric constant of the charging device, the relative dielectric constant having been measured in advance; and controls a voltage to be applied to the charging device, to apply the peak-to-peak voltage calculated by the hardware processor to the charging device.

11 Claims, 10 Drawing Sheets

IMAGE FORMING APPARATUS AND METHOD OF CONTROLLING IMAGE FORMING APPARATUS

The entire disclosure of Japanese patent Application No. 2017-181268, filed on Sep. 21, 2017, is incorporated herein by reference in its entirety.

BACKGROUND

Technological Field

The present disclosure relates to an image forming apparatus and a method of controlling the image forming apparatus, and more particularly, to an image forming apparatus including a photoreceptor and a charging device, and a method of controlling the image forming apparatus.

Description of the Related Art

There are conventional image forming apparatuses using the electrophotographic method, such as copying machines, printers, facsimile machines, and multi-functional peripherals of them. In a conventional image forming apparatus, a photoreceptor having a photosensitive layer formed on its surface is electrically charged by a charging device, and exposure based on image data is then performed on the photoreceptor by an exposure device. In this manner, an electrostatic latent image is formed on the surface of the photoreceptor. As toner is supplied to the photoreceptor having the electrostatic latent image formed thereon from a developing roller to which a developing bias potential is applied, a toner image corresponding to the electrostatic latent image is formed on the surface of the photoreceptor.

Referring to FIG. 13, an AC roller charging method is described as a method of electrically charging the surface of a photoreceptor 10. According to the AC roller charging method, a charging roller 11 is brought into contact with or close to the surface of the photoreceptor 10, and a voltage of a peak-to-peak voltage Vpp obtained by superimposing an AC voltage on a DC voltage is applied to the charging roller 11, to electrically charge the surface of the photoreceptor 10.

By this method, a potential difference is generated between the charging roller 11 and the photoreceptor 10 by the voltage applied to the charging roller 11. If the potential difference exceeds a potential difference determined by the Paschen's law, electric discharge occurs between the charging roller 11 and the photoreceptor 10. As a result, the photoreceptor 10 is electrically charged.

The potential of the surface of the photoreceptor 10 electrically charged by the charging roller 11 (this potential will be hereinafter referred to as the surface potential Vo) is determined in accordance with the magnitude of the peak-to-peak voltage Vpp of the voltage to be applied to the charging roller 11.

The surface potential Vo affects image quality. If the potential difference between the surface potential Vo and the developing bias potential becomes too small, the toner adheres to the background portion that should be a blank area (fogging). If the potential difference between the surface potential Vo and the developing bias potential becomes too large, on the other hand, carriers contained in the two-component developer adhere to the photoreceptor. In addition to that, if the potential difference between the surface potential Vo and the developing bias potential becomes too small or too large, streaky white portions or streaky stain due to the toner appears (streaks).

Further, if the voltage to be applied to the charging roller 11 is too high, the discharge energy increases. As a result, the scraping of the photosensitive film of the photoreceptor 10 is accelerated, and the life of the photoreceptor 10 is shortened. Therefore, the voltage to be applied to the charging roller 11 is controlled so that the surface potential Vo falls within a predetermined range.

One of the known methods for setting the peak-to-peak voltage Vpp within an appropriate range is a method disclosed in JP 2002-182455 A. Referring now to FIG. 14, the outline of this method is described. First, an image forming apparatus 100 receives an instruction to perform control for setting the peak-to-peak voltage Vpp within an appropriate range (this control will be hereinafter referred to as the "charging control"), and then performs the charging control through the steps described below.

Step 1: The voltage of the peak-to-peak voltage Vpp is applied at a plurality of points in the undischarged region, and the respective AC currents Iac are detected.

Step 2: In the discharged region, the voltage of the peak-to-peak voltage Vpp is also applied at a plurality of points, and the respective AC currents Iac are detected.

Step 3: The linear approximate expression $Y\beta$ of the undischarged region and the linear approximate expression $Y\alpha$ of the discharged region are calculated by the least squares method.

Step 4: A target discharge amount D is read from a memory (not shown).

Step 5: The peak-to-peak voltage Vpp at which the difference between the current on $Y\beta$ and the current on $Y\alpha$ becomes equal to the target discharge amount D is calculated.

Step 6: The calculated peak-to-peak voltage Vpp is applied to the charging roller 11.

However, JP 2002-182455 A discloses neither a method of changing the target discharge amount D nor a method of determining the target discharge amount D.

TABLE 1

| | Target discharge amount (μA) | Peak-to-peak voltage Vpp (V) | Fogging and streaks due to poor charging | Drum unit life |
|---|---|---|---|---|
| Drum unit 15A | 100 | 1600 | Observed (bad) | 110% |
| Drum unit 15B | 100 | 1600 | None observed | 110% |
| Drum unit 15C | 100 | 1600 | None observed | 105% |
| Drum unit 15D | 100 | 1600 | None observed | 100% |
| Drum unit 15E | 100 | 1600 | None observed | 95% (bad) |
| Drum unit 15F | 100 | 1600 | None observed | 90% (bad) |
| Drum unit 15G | 100 | 1600 | None observed | 80% (bad) |

As shown in Table 1, the studies made by the inventors have proved that, in a case where the target discharge amount D is constant, printing defects such as fogging or streaks might be caused due to poor charging in some charging roller 11 that is of the same type as any other charging roller 11, and the life of the drum unit might become lower than 100% (the life of the drum unit is 100% in a case where the drum unit is replaced with a new one immediately after the number of printed sheets has reached the number specified in the specification of the image forming apparatus 100). Note that the life is estimated from the change in the film thickness of the photosensitive layer of the photoreceptor 10.

SUMMARY

The present disclosure is made to solve the above described problems, and one of the objects of the present invention is to provide an image forming apparatus capable of preventing printing defects due to poor charging and improving the life of a photoreceptor, and a method of controlling the image forming apparatus.

To achieve at least one of the abovementioned objects, according to an aspect of the present invention, an image firming apparatus reflecting one aspect of the present invention comprises: a photoreceptor having a photosensitive layer formed on a surface; a charging device that electrically charges the surface of the photoreceptor through electric discharge between the charging device and the photoreceptor; and a hardware processor that: calculates a peak-to-peak voltage to be applied to the charging device, using a measured value of a relative dielectric constant of the charging device, the relative dielectric constant having been measured in advance; and controls a voltage to be applied to the charging device, to apply the peak-to-peak voltage calculated by the hardware processor to the charging device.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
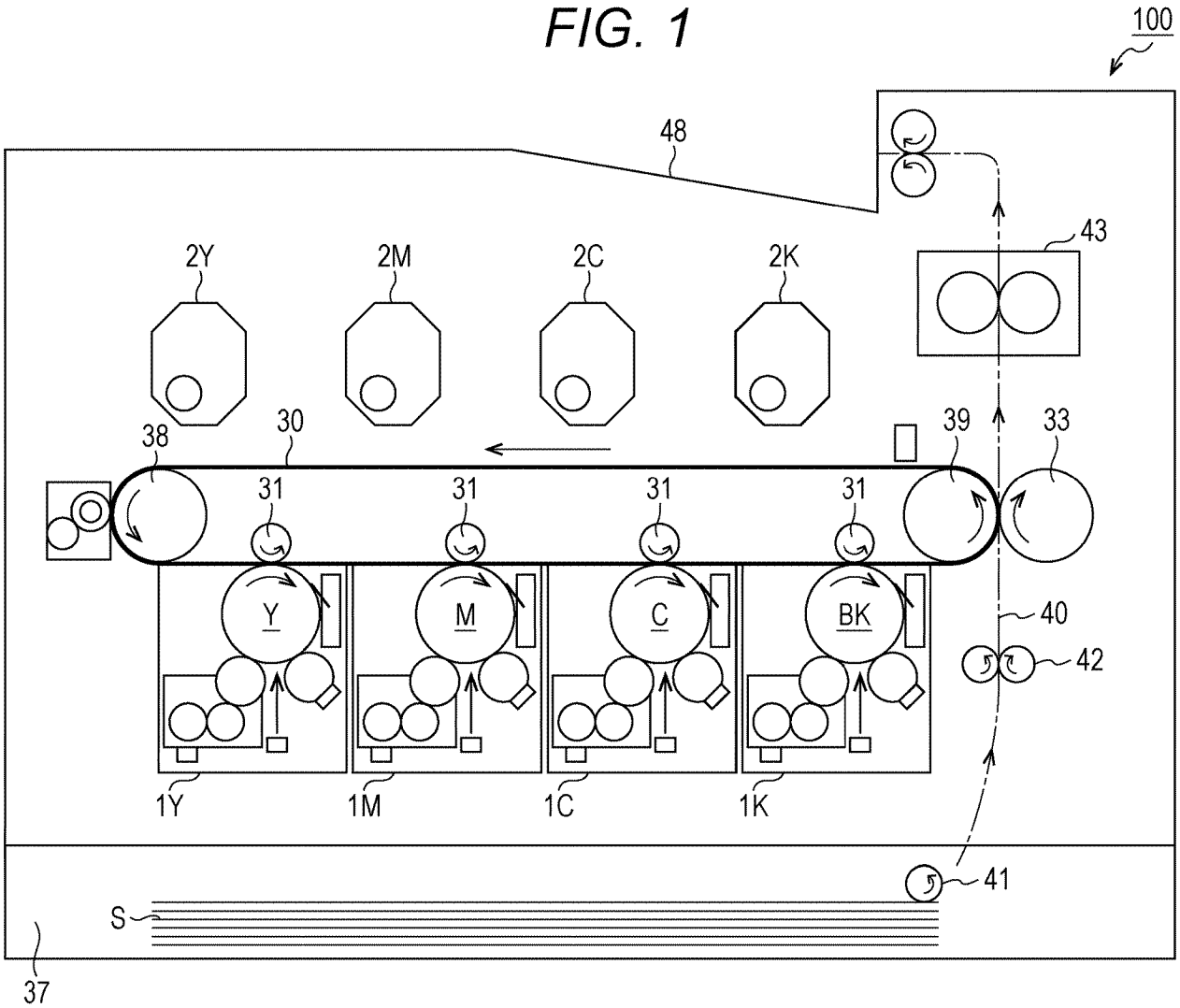
FIG. 1 is a diagram showing an example internal structure of an image forming apparatus according to this embodiment.

Hereinafter, one or more embodiments of the present invention will be described with reference to the drawings. However, the scope of the invention is not limited to the disclosed embodiments. In the description below, like components and constituent elements are denoted by like reference numerals. Like components and constituent elements also have like names and functions. Therefore, detailed explanation of them will not be unnecessarily repeated. It should be noted that the embodiments and the modifications described below may be selectively combined as appropriate.

First Embodiment

[Internal Structure of an Image Forming Apparatus]

Referring to FIG. 1, the internal structure of an image forming apparatus 100 is described. FIG. 1 is a diagram showing an example internal structure of the image forming apparatus 100 according to this embodiment.

The image forming apparatus 100 as a color printer is shown in FIG. 1. Although the image forming apparatus 100 as a color printer will be described below, the image forming apparatus 100 is not necessarily a color printer. For example, the image forming apparatus 100 may be a monochrome printer, a copying machine, a facsimile machine, or a multifunctional peripheral (MFP).

The image forming apparatus 100 includes image forming units 1Y, 1M, 1C, and 1K, an intermediate transfer belt 30, primary transfer rollers 31, a secondary transfer roller 33, a cassette 37, a following roller 38, a driving roller 39, a pick-up roller 41, timing rollers 42, and a fixing device 43.

The image forming units 1Y, 1M, 1C, and 1K are sequentially arranged along the intermediate transfer belt 30. The image forming unit 1Y receives a supply of toner from a toner bottle 2Y, and forms a yellow (Y) toner image. The image forming unit 1M receives a supply of toner from a toner bottle 2M, and forms a magenta (M) loner image. The image forming unit 1C receives a supply of toner from a toner bottle 2C, and forms a cyan (C) toner image. The image forming unit 1K receives a supply of toner from a toner bottle 2K, and forms a black (BK) toner image.

The image forming units 1Y, 1M, 1C, and 1K and the intermediate transfer belt 30 are in contact with one another at portions where the primary transfer rollers 31 are provided. The primary transfer rollers 31 is designed to be rotatable. As a transfer voltage of the opposite polarity of that of the toner image is applied to the primary transfer rollers 31, the toner images are transferred from the image forming units 1Y, 1M, 1C, and 1K onto the intermediate transfer belt 30.

In the case of a color print mode, the yellow (Y) toner image, the magenta (M) toner image, the cyan (C) toner image, and the black (BK) toner image are sequentially transferred onto the intermediate transfer belt 30 in an overlapping manner. As a result, a color toner image is formed on the intermediate transfer belt 30. In the case of a monochrome print mode, on the other hand, the black (BK) toner image is transferred from a photoreceptor 10 onto the intermediate transfer belt 30.

The intermediate transfer belt 30 is stretched around the following roller 38 and the driving roller 39. The driving roller 39 is rotationally driven by a motor (not shown), for example. The intermediate transfer belt 30 and the following roller 38 rotate with the driving roller 39. As a result, the toner image on the intermediate transfer belt 30 is conveyed to the secondary transfer roller 33.

Paper sheets S are stored in the cassette 37. The paper sheets S are sent one by one from the cassette 37 to the secondary transfer roller 33 along a conveyance path 40 by the pick-up roller 41 and the timing rollers 42. The secondary transfer roller 33 applies a transfer voltage of the opposite polarity of that of the toner image to the paper sheet S being conveyed. As a result, the toner image is attracted to the secondary transfer roller 33 from the intermediate transfer belt 30, and is transferred to an appropriate position on the paper sheet S.

The fixing device 43 pressurizes and heats the paper sheet S passing therethrough. As a result, the toner image formed on the paper sheet S is fixed to the paper sheet S. After that, the paper sheet S is discharged onto a tray 48.

[Internal Structure of an Image Forming Unit]

Figure 2:
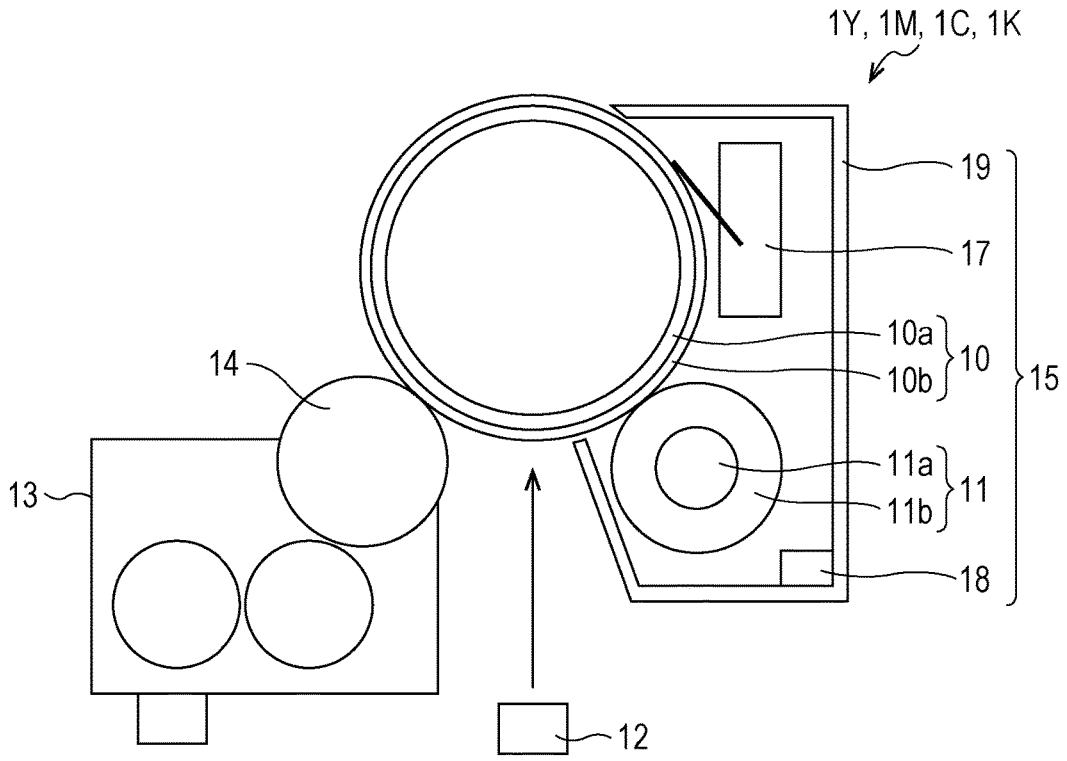
FIG. 2 is a diagram showing an example internal structure of an image forming unit included in the image forming apparatus according to this embodiment.

Referring now to FIG. 2, the internal structure of the image forming units 1Y, 1M, 1C, and 1K is described. FIG. 2 is a diagram showing an example internal structure of the image forming units Y, 1M, 1C, and 1K included in the image forming apparatus 100 according to this embodiment.

As shown in FIG. 2, each of the image forming units 1Y, 1M, 1C, and 1K includes a drum unit 15, an exposure device 12, and a developing device 13.

The drum unit 15 includes a photoreceptor 10, a charging roller 1, a cleaning device 17, an integrated circuit (IC) chip 18, and a support 19. The drum unit 15 is detachably attached to the image forming apparatus 100. In case where the photoreceptor 10 as the principal component deteriorates, the drum unit 15 is detached from the image forming apparatus 100, and a new drum unit 15 is attached to the image forming apparatus 100.

The support 19 supports the photoreceptor 10, the charging roller 11, the cleaning device 17, and the IC chip 18, to turn these components into a unit.

The photoreceptor 10 includes a drum-like (cylindrical) substrate 10*a* made of aluminum or the like, and a photosensitive layer 10*b* formed on the outer circumferential surface of the substrate 10*a*. A toner image is formed on the outer circumferential surface of the photoreceptor 10.

The photosensitive layer 10*b* is made of an organic material, and includes a charge generation layer and a charge transport layer formed on the charge generation layer. The charge generation layer is a layer that generates electric charges through exposure, and the charge transport layer is a layer that transports holes generated in the charge generation layer to the surface of the photoreceptor 10. In addition to the charge generation layer and the charge transport layer, the photosensitive layer 10*b* may include an undercoat layer that is located closer to the substrate 10*a* than the charge generating layer and guides electrons generated in the charge generating layer to the substrate 10*a*, and an overcoat layer that protects the charge transport layer.

The charge generation layer of the photosensitive layer 10*b* contains a charge generating substance and a binder resin. Examples of the charge generating substance include azo raw materials such as Sudan Red and Diane Blue, quinone pigments such as pyrenequinone and anthanthrone, quinocyanine pigments, perylene pigments, indigo pigments such as indigo and thioindigo, phthalocyanine pigments, and the like. Examples of the binder resin include polystyrene resin, polyethylene resin, polypropylene resin, acrylic resin, methacrylic resin, vinyl chloride resin, vinyl acetate resin, polyvinyl butyral resin, epoxy resin, polyurethane resin, phenol resin, polyester resin, aikyd resin, polycarbonate resin, silicone resin, melamine resin, and copolymer resin containing two or more of these resins (such as vinyl chloride-vinyl acetate copolymer resin and vinyl chloride-vinyl acetate-maleic anhydride copolymer resin, for example), polyvinylcarbazole resin, and the like.

The charge transport layer of the photosensitive layer 10*b* contains a charge transporting substance and a binder resin. Examples of the charge transporting substance include carbazole derivatives, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, pyrazolines compounds, oxazolone derivatives, benzimidazole derivatives, quinazoline derivatives, benzofuran derivatives, acridine derivatives, phenazine derivatives, aminostilbene derivatives, triarylamine derivatives, phenylenediamine derivatives, stilbene derivatives, benzidine derivatives, poly-N-vinylcarbazole, poly-1-vinylpyrene, poly-9-vinylanthracene, and mixtures of two or more of these compounds.

Examples of the binder resin for the charge transport layer include polycarbonate resin, polyacrylate resin, polyester resin, polystyrene resin, styrene-acrylonitrile copolymer resin, polymethacrylate ester resin, styrene-methacrylate ester copolymer resin, and the like.

The charging roller 11 uniformly charges the peripheral surface of the photoreceptor 10. The charging roller 11 has an elongated shape along the rotation axis of the photoreceptor 10. The rotation axis of the charging roller 11 is parallel to the rotation axis of the photoreceptor 10.

The charging roller 11 includes a columnar shaft 11*a* formed with a metal (such as a stainless steel material) with rigidity, and an elastic layer 11*b* formed with a conductive or semiconductive elastic material on the peripheral surface of the shaft 11*a*. The elastic layer 11*b* may have a surface layer formed with a conductive resin material on its surface.

The elastic layer 11*b* is formed with an elastic material such as epichlorohydrin rubber (ECO, CO, or the like), nitrile rubber (NBR), ethylene-propylene-diene rubber (EPDM), silicone rubber, urethane rubber, styrene-butadiene rubber (SBR), isoprene rubber (IR), chloroprene rubber (CR), or natural rubber (NR), for example.

Examples of the conductive agent mixed in the elastic material forming the elastic layer 11*b* include carbon black such as Ketjen black and acetylene black, graphite, metal powder, conductive metal oxide, and various ion conductive agents including quaternary ammonium salts such as tetramethyl ammonium perchlorate, trimethyl octadecyl ammonium perchlorate, and benzyl trimethyl ammonium chloride.

The cleaning device 17 is pressed against the photoreceptor 10. The cleaning device 17 recovers the loner remaining on the surface of the photoreceptor 10 after the toner image transfer.

The IC chip 18 is attached to the support 19, and stores various kinds of information. The information stored in the IC chip 18 includes the cumulative number R of rotations since the start of use of the photoreceptor 10, the relative dielectric constant εpc of the photosensitive layer 10*b* of the photoreceptor 10, the film thickness dpc (new) of the photosensitive layer 10*b*, the thickness dr of the elastic layer 11*b* of the charging roller 11, and the relative dielectric constant εr of the elastic layer 11*b*.

The drum unit 15 includes a counter (not shown) that counts the cumulative number of rotations since the start of use of the photoreceptor 10. The cumulative number R of rotations counted by the counter is written into the IC chip 18 at any appropriate time.

The relative dielectric constant εpc of the photosensitive layer 10*b* depends on the material forming the photosensitive layer 10*b*, and is measured beforehand for each photoreceptor 10.

For example, the relative dielectric constant εpc and the film thickness dpc (new) of the photosensitive layer 10*b* are measured at the time of the shipment inspection of the photoreceptor 10, and the numerals or the barcode indicating the measured values is written on the photoreceptor 10. The portion on which the measured values are written is a portion other than the portion on which the toner image is formed on the photoreceptor 10.

Likewise, the relative dielectric constant εr of the elastic layer 11*b* depends on the material forming the elastic layer 11*b*, and is measured beforehand for each charging roller 11. The thickness dr of the elastic layer 11*b* is also measured beforehand for each charging roller 11.

For example, the relative dielectric constant εr and the thickness dr of the elastic layer 11*b* are measured at the time of the shipping inspection of the charging roller 11, and the numerals or the barcode indicating the measured values is written on the charging roller 11.

When assembling the drum unit 15, the worker reads the relative dielectric constant εpc and the film thickness dpc (new), and the relative dielectric constant εr and the thickness dr, which are respectively written on the photoreceptor 10 and the charging roller 11 incorporated into the drum unit 15, and writes the read relative dielectric constant εpc, film thickness dpc (new), relative dielectric constant εr, and thickness dr into the IC chip 18.

Alternatively, in a case where the relative dielectric constant εpc, the film thickness dpc (new), the relative dielectric constant εr, and the thickness dr are indicated by barcodes, it is possible to use a device that reads the relative dielectric constant εpc, the film thickness dpc (new), the relative dielectric constant εr, and the thickness dr from the barcodes, and writes the read relative dielectric constant εpc, film thickness dpc (new), relative dielectric constant εr, and thickness dr into the IC chip 18.

Note that the relative dielectric constant εpc, the film thickness dpc (new), the relative dielectric constant εr, and the thickness dr may be written into the IC chip 18 by a method other than the above methods. In the first embodiment, of these measured values, only the relative dielectric constant εr of the charging roller 11 is used, and therefore, only the relative dielectric constant εr may be written into the IC chip 18.

The exposure device 12 emits laser light onto the photoreceptor 10 in accordance with a control signal from a control device 60 that will be described later, and exposes the surface of the photoreceptor 10 in accordance with an image pattern that has been input. As a result, electric charge is generated at the exposed portion by the charge generation layer of the photosensitive layer 10*b*, and an electrostatic latent image corresponding to the input image is formed on the photoreceptor 10.

The developing device 13 applies a developing bias to a developing roller 14 while rotating the developing roller 14, so that toner adheres to the surface of the developing roller 14. The toner is then transferred from the developing roller 14 onto the photoreceptor 10, and a toner image corresponding to the electrostatic latent image is developed on the surface of the photoreceptor 10.

[Hardware Configuration of the Image Forming Apparatus]

Figure 3:
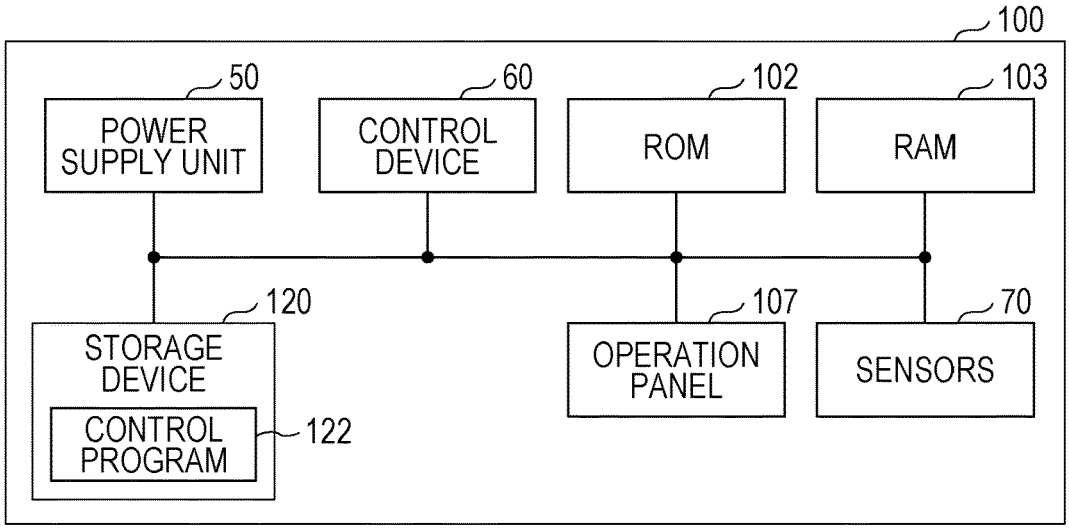
FIG. 3 is a block diagram showing an example of the hardware configuration of the image forming apparatus according to this embodiment.

Referring now to FIG. 3, an example of the hardware configuration of the image forming apparatus 100 is described. FIG. 3 is a block diagram showing the principal hardware configuration of the image forming apparatus 100.

As shown in FIG. 3, the image forming apparatus 100 includes a power supply unit 50, the control device 60, sensors 70, a read only memory (ROM) 102, a random access memory (RAM) 103, an operation panel 107, and a storage device 120.

The power supply unit 50 supplies power to the respective components (such as the charging roller 11 and the developing device 13 in FIG. 2) of the image forming apparatus 100.

The control device 60 is formed with at least one integrated circuit, for example. An integrated circuit is formed with al least one CPU, at least one CPU, at least one DSP, at least one application specific integrated circuit (ASIC), at least one field programmable gate array (FPGA), or a combination of these circuits.

The control device 60 controls operation of the image forming apparatus 100 by executing a control program 122 designed for the image forming apparatus 100. Upon receipt of an instruction to execute the control program 122, the control device 60 reads the control program 122 from the storage device 120 or the ROM 102. The RAM 103 functions as a working memory, and temporarily stores various kinds of data necessary for executing the control program 122.

The control device 60 controls the magnitude of the peak-to-peak voltage Vpp of the voltage to be applied from the power supply unit 50 to the charging roller 11 so that the surface potential Vo of the photoreceptor 10 charged by the charging roller 11 becomes substantially constant.

The operation panel 107 is formed with a display and a touch screen. The display and the touch screen are overlapped on each other. The operation panel 107 accepts a print operation, a scan operation, and the like for the image forming apparatus 100, for example.

The storage device 120 is a storage medium, such as a hard disk or an external storage device. The storage device 120 stores the control program 122 designed for the image forming apparatus 100, and the like. The location of storage of the control program 122 is not necessarily the storage device 120. The control program 122 may be stored in a storage area (such as a cache) in the control device 60, the ROM 102, the RAM 103, an external device (such as a server), or the like.

The control program 122 may not be provided as a single program, but may be incorporated into any appropriate program. In that case, the control process according to this embodiment is performed in cooperation with any appropriate program. Even such a program that does not include some modules does not depart from the scope of the control program 122 according to this embodiment. Further, some function(s) or all of the functions to be provided by the control program 122 may be provided by special-purpose hardware. Alternatively, the image forming apparatus 100 may be in the form a cloud service, and at least one server performs part of the process according to the control program 122.

[Control of the Voltage to be Applied to the Charging Roller 11]

Figure 4:
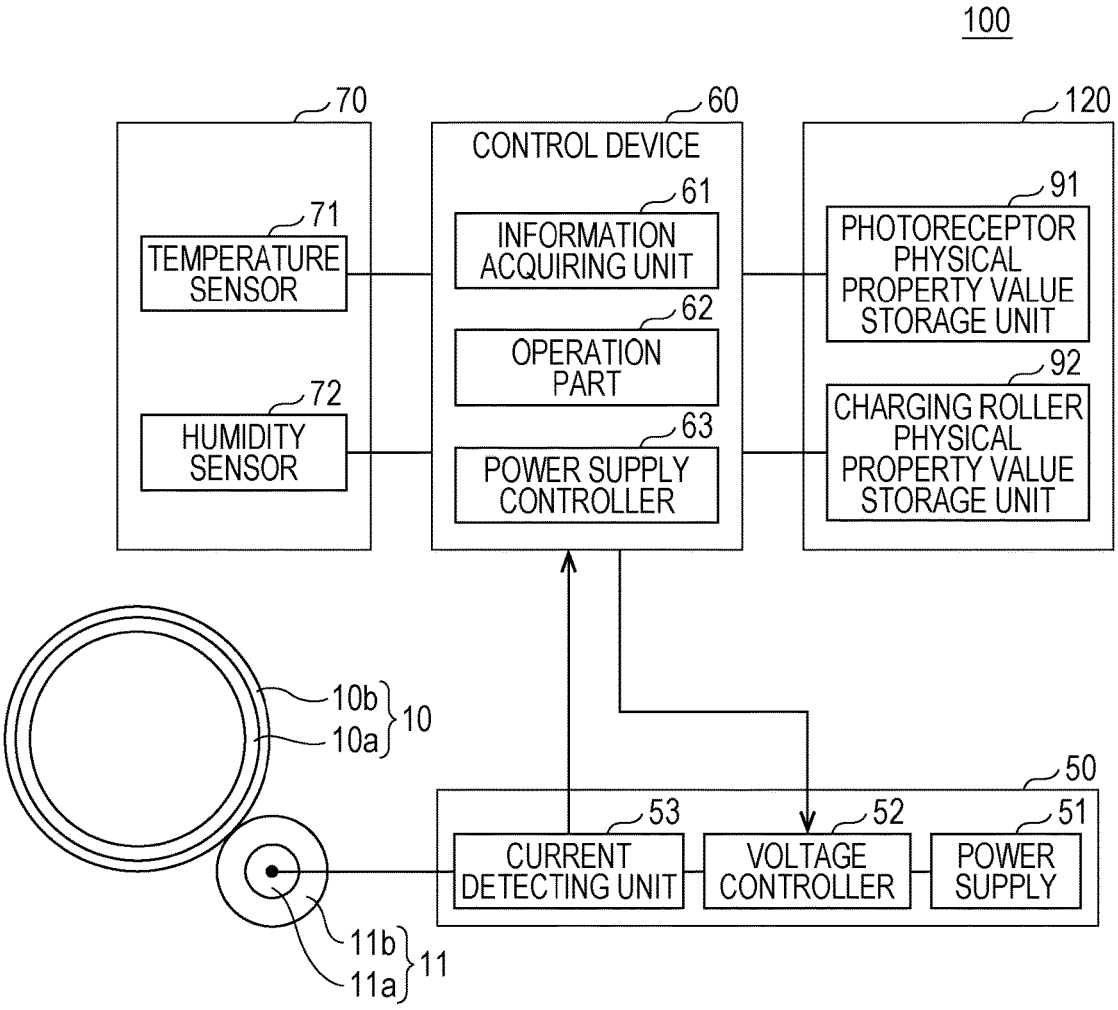
FIG. 4 is a block diagram showing a configuration relating to control of the voltage to be applied to the charging roller in the image forming apparatus according to this embodiment.

Referring now to FIG. 4, control of the peak-to-peak voltage Vpp of the voltage to be applied to the charging roller 11 is described in detail FIG. 4 is a block diagram showing a configuration relating to control of the voltage to be applied to the charging roller in the image forming apparatus according to this embodiment.

As shown in FIG. 4, the image forming apparatus 100 includes, as a configuration relating to control of the peak-to-peak voltage Vpp, the photoreceptor 10, the charging roller 11, the power supply unit 50, the control device 60, the sensors 70, and the storage device 120. The storage device 120 includes a photoreceptor physical property value storage unit 91 and a charging roller physical property value storage unit 92. The sensors 70 include a temperature sensor 71 and a humidity sensor 72.

The temperature sensor 71 is installed in the vicinity of the photoreceptor 10, and measures an ambient temperature T of the photoreceptor 10. The humidity sensor 72 is installed in the vicinity of the photoreceptor 10, and measures an ambient relative humidity of the photoreceptor 10.

The power supply unit 50 applies the voltage of the peak-to-peak voltage Vpp to the shaft 11*a* of the charging roller 11. When a voltage is applied to the shaft 11*a* of the charging roller 11, a potential difference is generated between the surface of the charging roller 11 and the surface of the photoreceptor 10. According to the Paschen's law, discharging occurs in the vicinity of the contact portion between the surface of the charging roller 11 and the surface of the photoreceptor 10, so that the photoreceptor 10 is electrically charged.

The photoreceptor physical property value storage unit 91 stores a physical property value of the photoreceptor 10. Specifically, the photoreceptor physical property value storage unit 91 stores the relative dielectric constant εpc of the photosensitive layer 10*b* of the photoreceptor 10.

The charging roller physical property value storage unit 92 stores physical property values of the charging roller 11. Specifically, the charging roller physical property value storage unit 92 stores the thickness dr of the elastic layer 11*b* of the charging roller 11 and the relative dielectric constant εr of the elastic layer 11*b*.

In the first embodiment, only the relative dielectric constant εr stored in the charging roller physical property value storage unit 92 is used, and therefore, the charging roller physical property value storage unit 92 may store only the relative dielectric constant cr. Further, the storage device 120 may not include the photoreceptor physical property value storage unit 91.

The control device 60 includes an information acquiring unit 61, an operation part 62, and a power supply controller 63. The information acquiring unit 61 functions as a physical property value acquiring unit that acquires a physical property value of the photoreceptor 10 and physical property values of the charging roller 11. The information acquiring unit 61 writes the acquired physical property value of the photoreceptor 10 into the photoreceptor physical property value storage unit 91, and writes the acquired physical property values of the charging roller 11 into the charging roller physical property value storage unit 92.

Specifically, the information acquiring unit 61 reads, from the IC chip 18 of the drum unit 15 mounted in the image forming apparatus 100, the relative dielectric constant εpc of the photosensitive layer 10*b* of the photoreceptor 10 and the film thickness of the photosensitive layer 10*b* in an unused state, and the thickness dr and the relative dielectric constant εr of the elastic layer 11*b* of the charging roller 11. The information acquiring unit 61 writes the read relative dielectric constant εpc into the photoreceptor physical property value storage unit 91, and writes the read thickness dr and the relative dielectric constant εr into the charging roller physical property value storage unit 92. As a result, the photoreceptor physical property value storage unit 91 can store a physical property value of the photoreceptor 10 mounted in the image forming apparatus 100. Likewise, the charging roller physical property value storage unit 92 can store physical property values of the charging roller 11 mounted in the image forming apparatus 100.

The power supply unit 50 includes a power supply 51, a voltage controller 52, and a current detecting unit 53. The power supply 51 supplies electric power. The voltage controller 52 controls the voltage to be applied to the charging roller 11. The current detecting unit 53 detects the value of the current to be applied to the charging roller 11.

In accordance with the value of the current detected by the current detecting unit 53, the temperature detected by the temperature sensor 71, the relative humidity detected by the humidity sensor 72, the processing speed, and the charging frequency, the operation part 62 calculates the peak-to-peak voltage Vpp of the voltage to be applied to the charging roller 11. The processing speed is the speed at which a paper sheet to be subjected to printing is conveyed, and is equal to the circumferential velocity of the rollers that convey the paper sheet, such as the circumferential velocity of the photoreceptor 10. As the circumferential velocity of the photoreceptor 10 is equal to the circumferential velocity of the charging roller 11, the circumferential velocity of the charging roller 11 is equal to the processing speed.

The power supply controller 63 controls the voltage controller 52 of the power supply unit 50 so that the voltage of the peak-to-peak voltage Vpp calculated by the operation part 62 is applied to the shaft 11*a* of the charging roller 11.

[Process Flow in the Image Forming Apparatus According to the First Embodiment]

Figure 5:
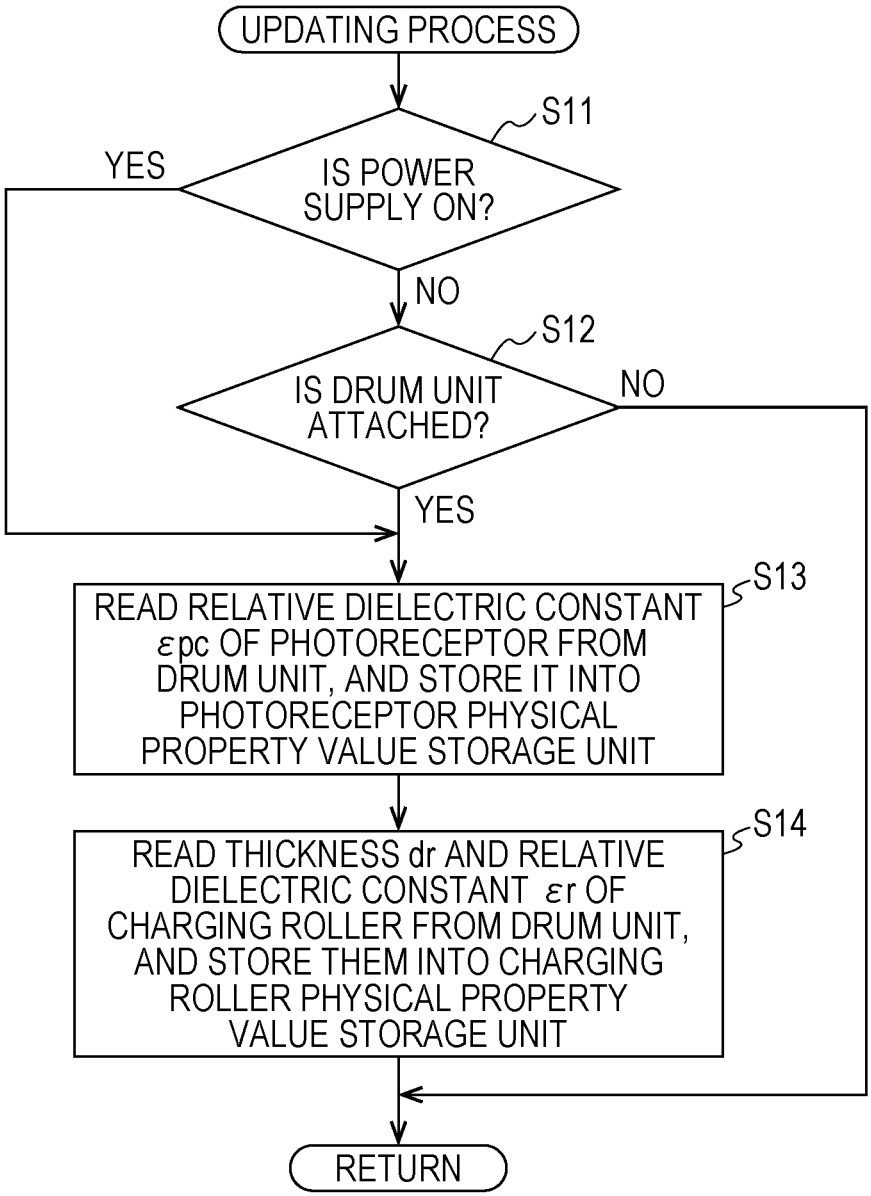
FIG. 5 is a flowchart showing the flow in a physical property value updating process to be performed by the image forming apparatus according to this embodiment.

Referring now to FIG. 5, the flow in a physical property value updating process in the image forming apparatus 100 is described. FIG. 5 is a flowchart showing the flow in a physical property value updating process to be performed by the image forming apparatus 100 according to this embodiment.

As shown in FIG. 5, the information acquiring unit 61 determines whether the power supply to the image forming apparatus 100 is on (step S11). If it is determined that the power supply is not on (NO in step S11), the information acquiring unit 61 determines whether the dram unit 15 is attached (step S2). To attach the drum unit 15 to the image forming apparatus 100, it is necessary to open and close a door formed in the image forming apparatus 100. The information acquiring unit 61 should determine that the drum unit 15 is attached to the image forming apparatus 100 when sensing that the door has changed from an opened state to a closed state. If it is determined that the drum unit 15 is not attached (NO in step S12), the information acquiring unit 61 returns the process to be performed to the caller of this process.

If it is determined that the power supply is on (YES in step S1), and if it is determined that the drum unit 15 is attached (YES in step S12), the information acquiring unit 61 reads the relative dielectric constant εpc of the photosensitive layer 10*b* and the film thickness dpc (new) of the photosensitive layer 10*b* in an unused state from the 1C chip 18 of the drum unit 15, and writes the relative dielectric constant εpc and the thickness dpc (new) into the photoreceptor physical property value storage unit 91 (step S13).

The information acquiring unit 61 then reads the thickness dr and the relative dielectric constant εr of the elastic layer 11*b* of the charging roller 11 from the IC chip 18 of the drum unit 15, and writes the thickness dr and the relative dielectric constant εr into the charging roller physical property value storage unit 92 (step S14).

As a result, the physical property value of the photoreceptor 10 stored in the photoreceptor physical property value storage unit 91 is updated to a value corresponding to the currently attached photoreceptor 10. Likewise, the physical property values stored in the charging roller physical property value storage unit 92 are updated to values corresponding to the currently attached charging roller 11.

Figure 6:
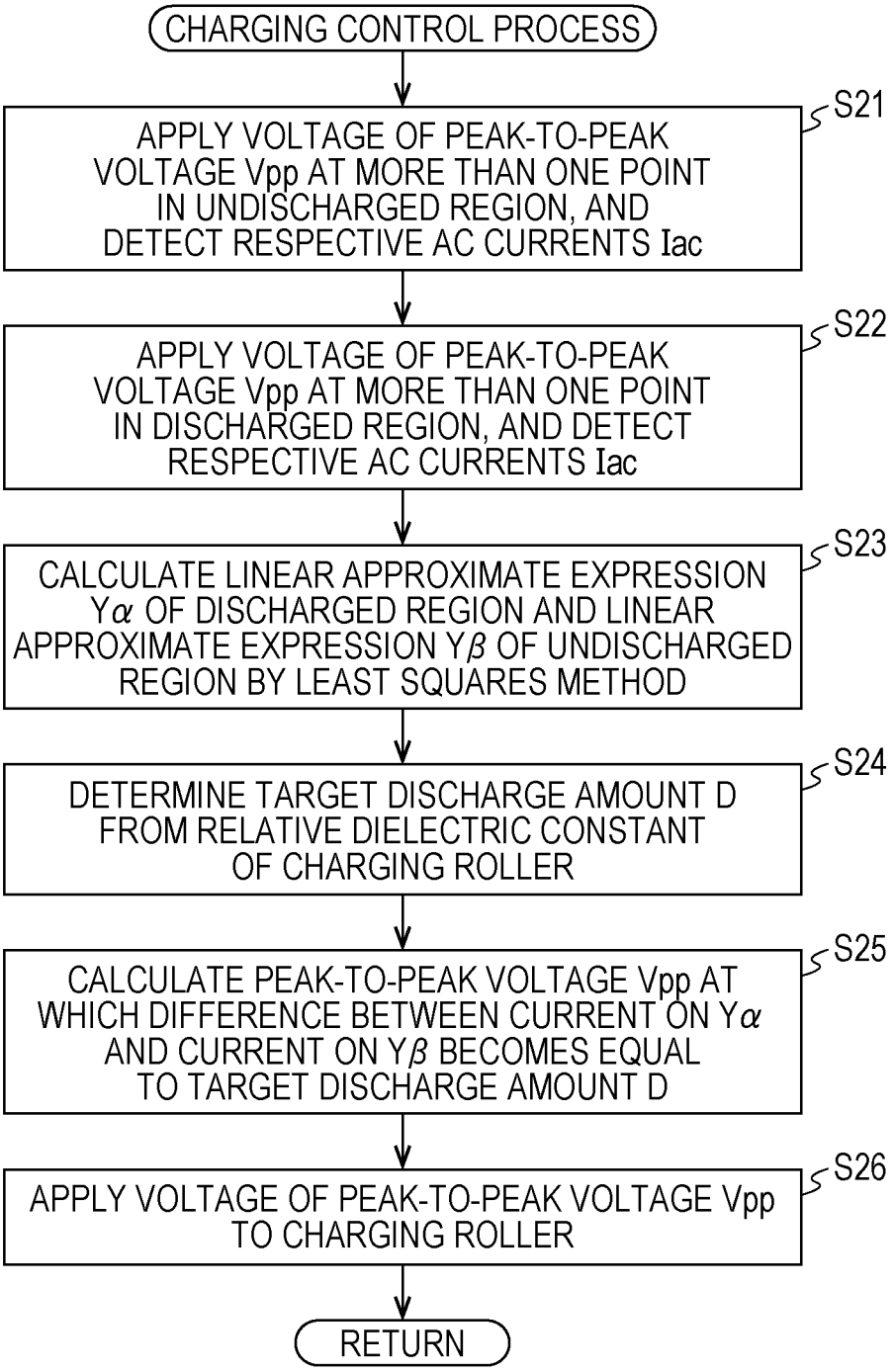
FIG. 6 is a flowchart showing the flow in a charging control process to be performed by the image forming apparatus according to the first embodiment.

Referring now to FIG. 6, the flow in a charging control process in the image forming apparatus 100 is described. FIG. 6 is a flowchart showing the flow in a charging control process to be performed by the image forming apparatus 100 according to the first embodiment.

Upon receipt of a printing instruction, the image forming apparatus 100 performs the charging control process shown in FIG. 6. The image forming apparatus 100 can receive a printing instruction through the operation panel 107 (see FIG. 3) or a network interface (not shown).

Figure 14:
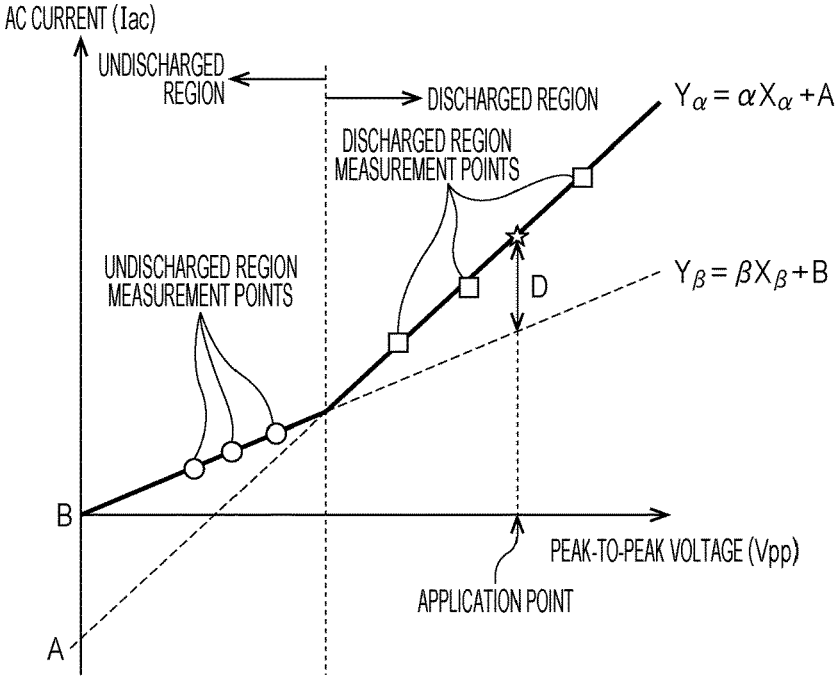
FIG. 14 is a graph for explaining a method of calculating a peak-to-peak voltage as the voltage to be applied to the charging roller.

As shown in FIG. 6, the operation part 62 applies the voltage of the peak-to-peak voltage Vpp at a plurality of points in the undischarged region as shown in FIG. 14 relating to the background art, and detects the respective AC currents Iac (step S21). In the discharged region, the operation part 62 also applies the voltage of the peak-to-peak voltage Vpp at a plurality of points, and detects the respective AC currents Iac (step S22).

The operation part 62 then calculates the linear approximate expression Yα of the discharged region and the linear approximate expression Yβ of the undischarged region by the least squares method (step S23).

Unlike that of the background art, the operation part 62 reads the relative dielectric constant εr of the charging roller 11 from the charging roller physical property value storage unit 92, and determines a target discharge amount D from the read relative dielectric constant εr (step S24). The determination method used herein will be described later.

The operation part 62 then calculates the peak-to-peak voltage Vpp at which the difference between the current on Yα and the current on Yβ becomes equal to the target discharge amount D (step S25). The power supply controller 63 controls the voltage controller 52 of the power supply unit 50 so that the voltage of the peak-to-peak voltage Vpp calculated in step S25 is applied to the charging roller 11. As a result, the voltage of the peak-to-peak voltage Vpp is applied to the charging roller 11 (step S26).

Alter that, an exposure process is performed by the exposure device 12, a developing process is performed by the developing device 13, a process of primary transfer to the intermediate transfer belt is performed, a process of secondary transfer to the paper sheet S is performed, and a fixing process is performed by the fixing device 43. Thus, the printing process is completed.

[Method of Determining the Target Discharge Amount D]

As described above as the problem to be solved by the invention, printing defects and degradation of the life of the photoreceptor might be caused by poor charging in a case where the target discharge amount D or the peak-to-peak voltage Vpp is constant. The inventors considered the possibility that the reason of this problem is the variation of the relative dielectric constant of the charging roller 11.

The relative dielectric constant of the charging roller 11 is the ratio between the dielectric constant of the charging roller 11 and the dielectric constant of vacuum. A dielectric constant is a count that indicates the relationship between charge and the force given by the charge within a substance. If the relative dielectric constant of the charging roller 11 is high, it is considered that the charges in the charging roller 11 easily move, and discharging easily occurs at a constant peak-to-peak voltage Vpp. If the relative dielectric constant is low, it is considered that the charges in the charging roller 11 hardly move, and discharging becomes difficult at a constant peak-to-peak voltage Vpp.

Figure 7A:
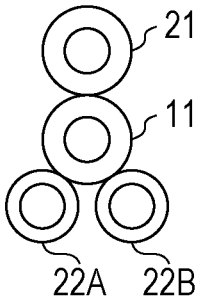
FIGS. 7A and 7B are diagrams for explaining a method of measuring the relative dielectric constant of the charging roller according to this embodiment.
Figure 7B:
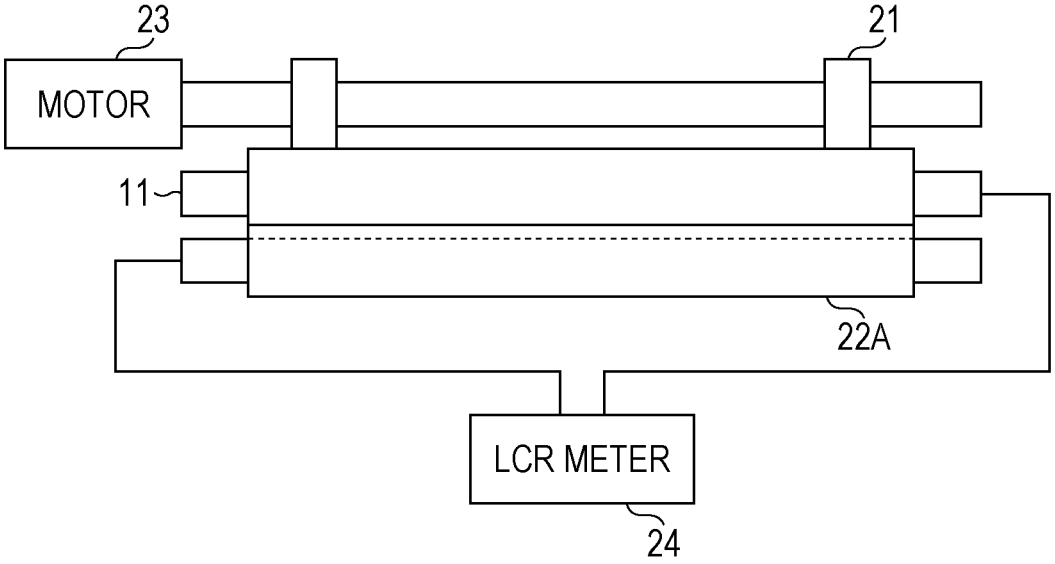

Therefore, the relative dielectric constant of the charging roller 11 was measured by the method described below. FIGS. 7A and 7B are diagrams for explaining a method of measuring the relative dielectric constant of the charging roller 11 according to this embodiment. As shown in FIGS. 7A and 7B, the charging roller 11 is placed on rotatable metal rollers 22A and 22B. A load is then applied to the charging roller 11 from above by a driving roller 21. Two terminals of an LCR meter 24 (ZM2372 manufactured by NF Corporation, for example) are connected to the metal roller 22A (or the metal roller 22B) and the charging roller 11, respectively.

The driving roller 21 is then made to rotate at a constant number of rotations by a motor 23, so that a voltage at a constant frequency can be applied by the LCR meter 24 while the charging roller 11 and the metal rollers 22A and 22B are made to rotate. The relative dielectric constants of charging rollers 11A through 11G were measured, and the values shown in Table 2 were obtained. As can be seen from the results, the relative dielectric constants vary among the charging rollers 11A through 11G that are of the same kind and were manufactured by the same manufacturing method.

TABLE 2

| | Charging roller relative dielectric constant |
|---|---|
| Charging roller 11A | 230 |
| Charging roller 11B | 240 |
| Charging roller 11C | 245 |
| Charging roller 11D | 250 |
| Charging roller 11E | 255 |
| Charging roller 11F | 260 |
| Charging roller 11G | 265 |

Therefore, in a case where the relative dielectric constant of the charging roller 11 is high, the target discharge amount D is lowered so that the peak-to-peak voltage Vpp becomes lower. In a case where the relative dielectric constant is low, the target discharge amount D is made higher so that the peak-to-peak voltage Vpp becomes higher.

TABLE 3

| Charging roller relative dielectric constant | Target discharge amount (μA) |
|---|---|
| 1 | 500 |
| . | . |
| . | . |
| . | . |
| 230 | 105 |
| 240 | 100 |
| 245 | 97 |
| 250 | 95 |
| 255 | 93 |
| 260 | 90 |
| 265 | 87 |
| . | . |
| . | . |
| . | . |
| 500 | 1 |

Specifically, a look-up table in which the relative dielectric constants of the charging rollers 11 are associated with target discharge amounts D as shown in Table 3 is stored beforehand into the storage device 120 of the image forming apparatus 100. In step S24 in FIG. 6 described above, the relative dielectric constant εr of the charging roller 11 is read from the charging roller physical property value storage unit 92, and the target discharge amount D corresponding to the read relative dielectric constant εr is read from this look-up table.

Note that the relational expression D=f(εr) between the relative dielectric constant εr of the charging roller 11 and the target discharge amount D may be stored beforehand into the storage device 120 of the image forming apparatus 100, and the target discharge amount D corresponding to the relative dielectric constant εr read from the charging roller physical property value storage unit 92 may be calculated from this relational expression.

For each of the drum units 15A through 15G including the charging rollers 11A through 11G, respectively, the voltage of the peak-to-peak voltage Vpp calculated from the target discharge amount D determined in this manner was applied to each of the charging rollers 11A through 11G, and a printing endurance test was conducted, to obtain the results shown in Table 4.

TABLE 4

| | Charging roller relative dielectric constant | Target discharge amount (μA) | Peak-to-peak voltage Vpp (V) | Fogging and streaks due to poor charging | Drum unit life |
|---|---|---|---|---|---|
| Drum unit 15A | 230 | 105 | 1620 | None observed | 110% |
| Drum unit 15B | 240 | 100 | 1600 | None observed | 110% |
| Drum unit 15C | 245 | 97 | 1590 | None observed | 110% |
| Drum unit 15D | 250 | 95 | 1580 | None observed | 110% |
| Drum unit 15E | 255 | 93 | 1570 | None observed | 110% |
| Drum unit 15F | 260 | 90 | 1560 | None observed | 110% |
| Drum unit 15G | 265 | 87 | 1550 | None observed | 110% |

The target discharge amount D was changed in accordance with the relative dielectric constant εr of the charging roller 11, so that the peak-to-peak voltage Vpp was changed.

Thus, as can be seen from the above table, the printing defects due to poor charging were prevented, and the life of the photoreceptor 10 was improved as compared with the results shown in Table 1 obtained in a case where the target discharge amount D was constant.

Further, to the charging roller 11A, the inventors applied the voltage of the peak-to-peak voltage Vpp calculated from the target discharge amount D determined from the relative dielectric constant εr of the charging roller 11A. In this case, a printing endurance test was conducted by changing the processing speed, the ambient temperature and the ambient relative humidity, and the frequency of the voltage to be applied (this frequency is referred to as the "charging frequency"). As a result, printing defects and degradation of the life of the photoreceptor 10 due to poor charging occurred as shown in Table 5.

TABLE 5

| Charging roller relative dielectric constant | Processing speed | Temperature/humidity | Charging frequency (Hz) | Target discharge amount (μA) | Peak-to-peak voltage Vpp (V) | Fogging and streaks due to poor charging | Drum unit life |
|---|---|---|---|---|---|---|---|
| 230 | 160 | Medium temperature/ medium humidity | 1300 | 105 | 1620 | None observed | 110% |
| 230 | 80 | Medium temperature/ medium humidity | 1300 | 105 | 1620 | None observed | 95% (bad) |
| 230 | 160 | Low temperature/ low humidity | 1300 | 105 | 1620 | Observed (bad) | 110% |
| 230 | 160 | Medium temperature/ medium humidity | 2000 | 105 | 1620 | Observed (bad) | 110% |

The relative dielectric constant of the charging roller 11 is the mobility of the charges in the charging roller 11. Therefore, if the processing speed is low, the charges easily move. Accordingly, the relative dielectric constant becomes higher, and the peak-to-peak voltage can be low, if the temperature and the relative humidity are high, the charges do not easily move. Therefore, the relative dielectric constant becomes lower, and a high peak-to-peak voltage is required. If the charging frequency is high, it becomes difficult for the charges to follow. Therefore, the relative dielectric constant becomes lower, and a high peak-to-peak voltage is required.

Figure 8:
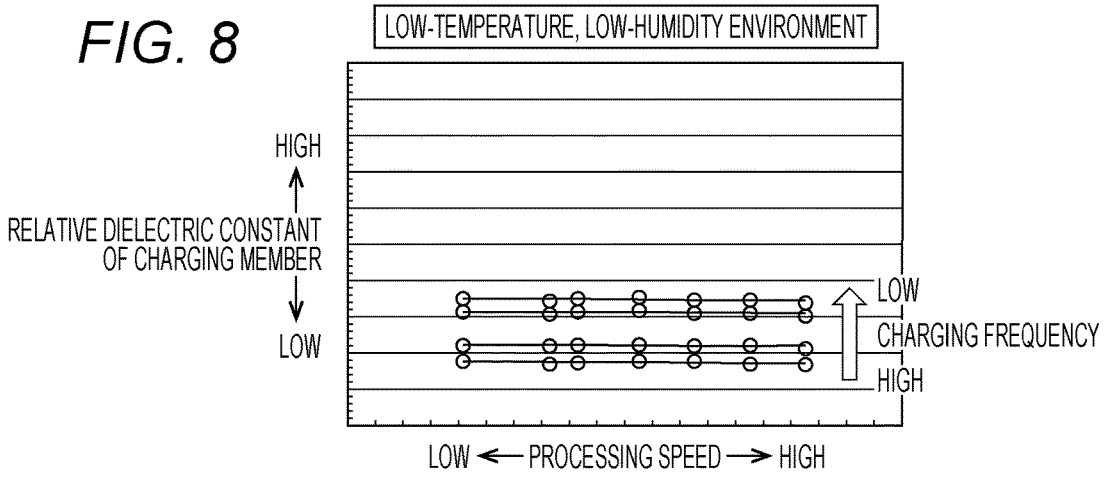
FIG. 8 is a graph showing changes in the relative dielectric constant with the charging frequency and the processing speed in a low-temperature, low-humidity environment.
Figure 9:
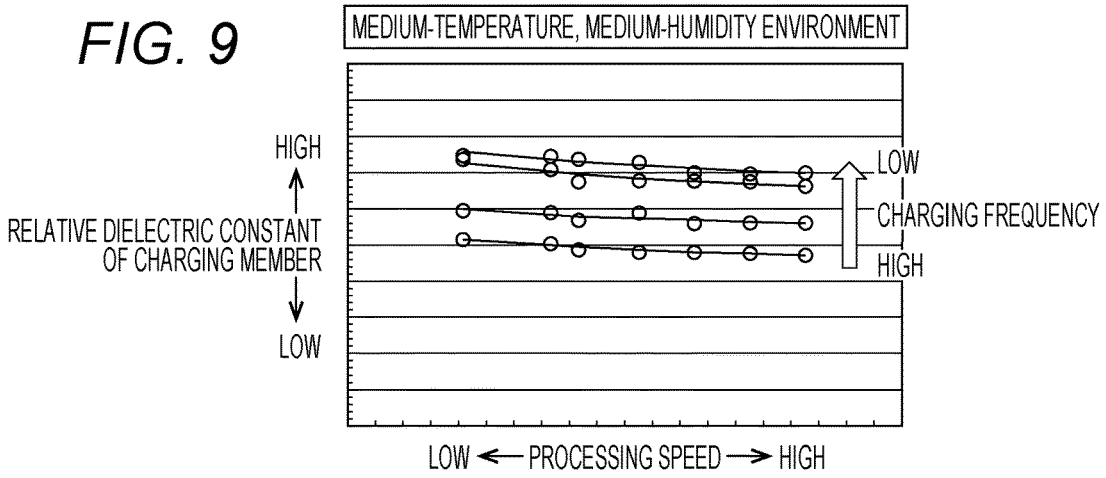
FIG. 9 is a graph showing changes in the relative dielectric constant with the charging frequency and the processing speed in a medium-temperature, medium-humidity environment.
Figure 10:
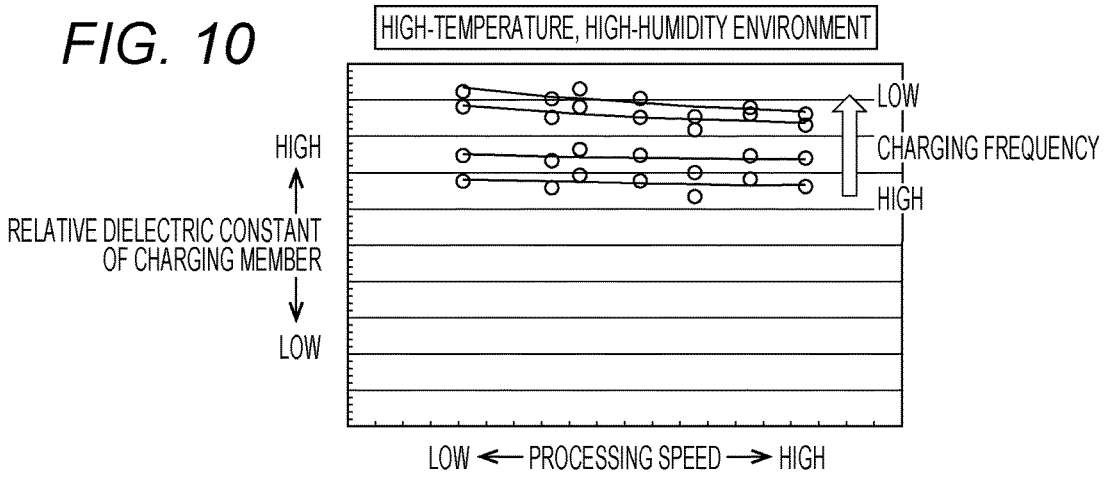
FIG. 10 is a graph showing changes in the relative dielectric constant with the charging frequency and the processing speed in a high-temperature, high-humidity environment.

In view of the above, experiments were conducted to measure relative dielectric constants while the processing speed, the temperature and the relative humidity, and the charging frequency were changed. FIGS. 8, 9, and 10 are diagrams showing changes in the relative dielectric constant with the charging frequencies and the processing speeds in a low-temperature, low-humidity environment, an medium-temperature, medium-humidity environment, and a high-temperature, high-humidity environment. As shown in FIGS. 8 through 10, the obtained results are as expected. Specifically, the lower the processing speed, the higher the relative dielectric constant. The higher the temperature and the relative humidity, the lower the relative dielectric constant. The higher the charging frequency, the lower the relative dielectric constant.

Therefore, in a case where the processing speed is lowered (from 160 mm/s to 80 mm/s in this example) as shown in the first and second rows in Table 5, a value that is made greater (by 20, or increased to 250 in this example) than the relative dielectric constant (230 in this example) stored in the charging roller physical property value storage unit 92 is set as the relative dielectric constant to be used in determining the target discharge amount D, as shown in the second row in Table 6.

Also, in a case where the temperature and the relative humidity are lowered (from a medium temperature and a medium humidity to a low temperature and a low humidity in this example) as shown in the first and third rows in Table 5, a value that is made smaller (by 30, or decreased to 200 in this example) than the relative dielectric constant (230 in this example) stored in the charging roller physical property value storage unit 92 is set as the relative dielectric constant to be used in determining the target discharge amount D, as shown in the third row in Table 6.

Further, in a case where the charging frequency is made higher (from 1300 Hz to 2000 Hz in this example) as shown in the first and fourth rows in Table 5, a value that is made smaller (by 20, or decreased to 210 in this example) than the relative dielectric constant (230 in this example) stored in the charging roller physical property value storage unit 92 is set as the relative dielectric constant to be used in determining the target discharge amount D, as shown in the fourth row in Table 6.

The target discharge amount D is determined from the relative dielectric constant as described above, the peak-to-peak voltage Vpp is calculated, and the calculated voltage of the peak-to-peak voltage Vpp is applied to the charging roller 11. Thus, printing defects due to poor charging can be prevented, and the life of the photoreceptor 10 can be improved.

Table 6 shows an example of how much the relative dielectric constant is changed in a case where the processing speed, the temperature and the relative humidity, or the charging frequency is individually changed. However, in a case where these measured values are changed in combination, the relative dielectric constant is changed in accordance with the combination, so that printing defects due to poor charging can be prevented, and the life of the photoreceptor 10 can be improved.

For example, in a case where the processing speed is changed from 160 mm/s to 80 mm/s, and the temperature and the relative humidity are changed from a medium temperature and a medium humidity to a low temperature and a low humidity, the relative dielectric constant is increased by 20 and is decreased by 30, or is decreased by 10.

TABLE 6

| Charging roller relative dielectric constant | Processing speed | Temperature/humidity | Charging frequency (Hz) | Target discharge amount (μA) | Peak-to-peak voltage Vpp (V) | Fogging and streaks due to poor charging | Drum unit life |
|---|---|---|---|---|---|---|---|
| 230 | 160 | Medium temperature/ medium humidity | 1300 | 105 | 1620 | None observed | 110% |
| 250 | 80 | Medium temperature/ medium humidity | 1300 | 90 | 1590 | None observed | 110% |
| 200 | 160 | Low temperature/ low humidity | 1300 | 115 | 1680 | None observed | 110% |
| 210 | 160 | Medium temperature/ medium humidity | 2000 | 110 | 1650 | None observed | 110% |

Second Embodiment

In the first embodiment, the power supply unit 50 of the image forming apparatus 100 includes the current detecting unit 53 as shown in FIG. 4, and the peak-to-peak voltage Vpp of the voltage to be applied to the charging roller 11 is calculated from the value of the current detected by the current detecting unit 53. In a second embodiment, on the other hand, an image forming apparatus 100A does not include the current detecting unit 53, and calculates the peak-to-peak voltage Vpp of the voltage to be applied to the charging roller 11, without the use of a current value.

Figure 11:
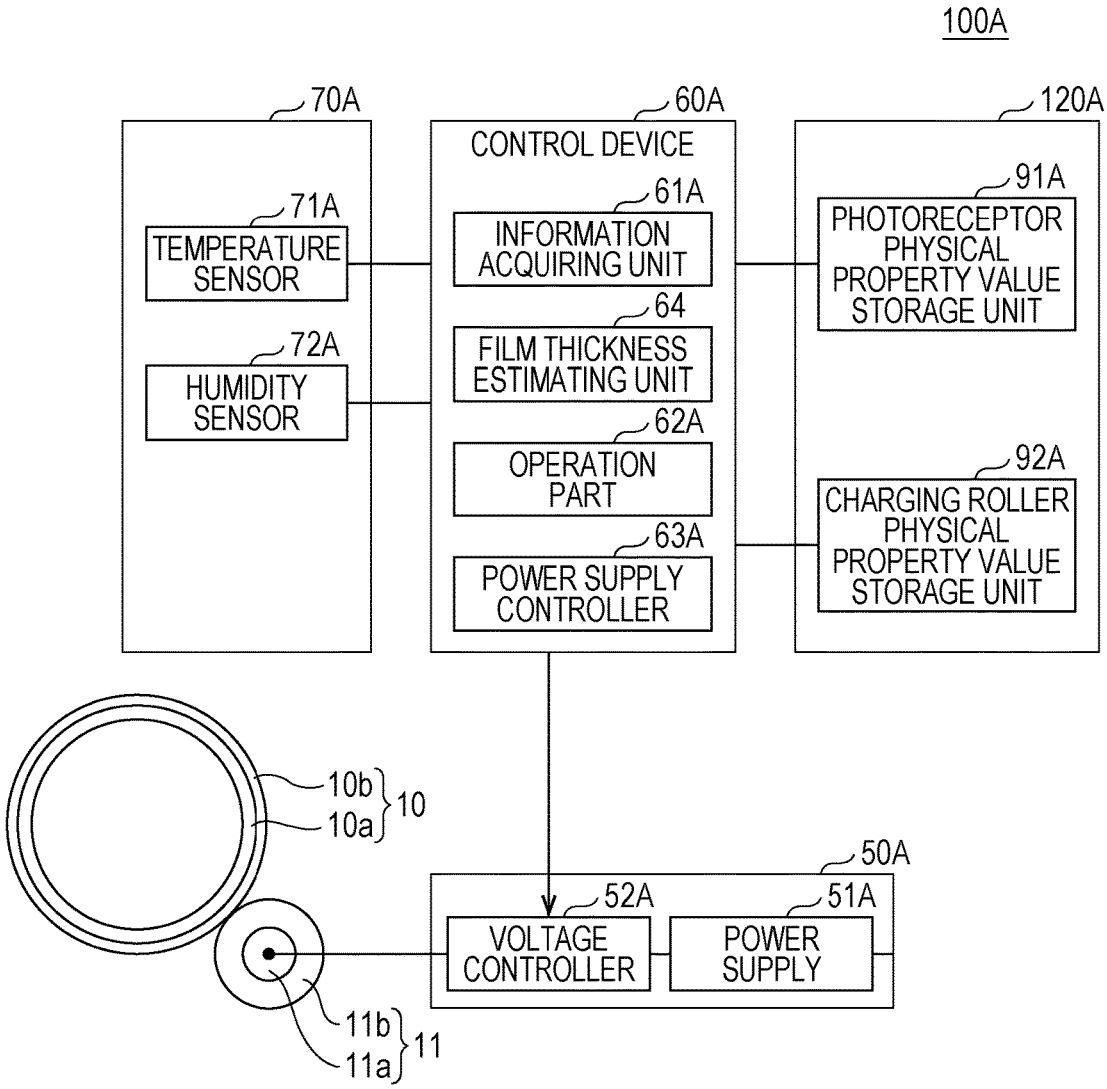
FIG. 11 is a block diagram showing a configuration relating to control of the voltage to be applied to a charging roller in an image forming apparatus according to a second embodiment.

FIG. 11 is a block diagram showing a configuration relating to control of the voltage to be applied to the charging roller 11 in the image forming apparatus 100A according to the second embodiment. As shown in FIG. 11, the image forming apparatus 100A includes, as a configuration relating to control of the peak-to-peak voltage Vpp, a photoreceptor 10, a charging roller 11, a power supply unit 50A, a control device 60A, sensors 70A, and a storage device 120A. The storage device 120A includes a photoreceptor physical property value storage unit 91A and a charging roller physical property value storage unit 92A. The sensors 70A include a temperature sensor 71A and a humidity sensor 72A.

The photoreceptor physical property value storage unit 91A and the charging roller physical property value storage unit 92A, and the temperature sensor 71A and the humidity sensor 72A are the same as the photoreceptor physical property value storage unit 91 and the charging roller physical property value storage unit 92 and the temperature sensor 71 and the humidity sensor 72 described above with reference to FIG. 4, and therefore, explanation of them is not repeated herein.

The control device 60A includes an information acquiring unit 61A, a film thickness estimating unit 64, an operation part 62A, and a power supply controller 63A. The power supply unit 50A includes a power supply 51A and a voltage controller 52A. The information acquiring unit 61A, the power supply 51A, and the voltage controller 52A are the same as the information acquiring unit 61, the power supply 51, and the voltage controller 52 described with reference to FIG. 4, and therefore, explanation of them is not repeated herein.

Further, upon receipt of a request from the film thickness estimating unit 64, the information acquiring unit 61A reads the cumulative number R of rotations since the start of use of the photoreceptor 10 from the IC chip 18, and outputs the read cumulative number R of rotations to the film thickness estimating unit 64.

The film thickness estimating unit 64 functions as a film thickness acquiring unit by estimating the current thickness dpc of the photosensitive layer 10*b* of the photoreceptor 10. The film thickness estimating unit 64 reads the initial film thickness dpc (new) of the photosensitive layer 10*b* from the photoreceptor physical property value storage unit 91A, and receives the cumulative number R of rotations of the photoreceptor 10 from the information acquiring unit 61A. The film thickness estimating unit 64 calculates the film thickness dpc according to Equation (1): dpc=dpc (new)−(C×R).

In Equation (1), the coefficient C is a constant indicating the amount of decrease in the film thickness of the photosensitive layer 10*b* per unit number of rotations, and is set beforehand through experiments or the like. The film thickness estimating unit 64 stores the coefficient C in advance. For example, in a case where C is 0.02 m/1000 times, dpc (new) is 40 μm, and the cumulative number R of rotations is 100000, the film thickness estimating unit 64 estimates the film thickness dpc to be 38 μm.

The operation part 62A calculates the peak-to-peak voltage Vpp of the voltage to be applied to the charging roller 11, in accordance with the current thickness dpc of the photosensitive layer 10*b* estimated by the film thickness estimating unit 64, the relative dielectric constant εpc of the photosensitive layer 10*b* stored in the photoreceptor physical property value storage unit 91A, the thickness dr and the relative dielectric constant εr of the elastic layer 11*b* stored in the charging roller physical properly value storage unit 92A, and the temperature T measured by the temperature sensor 71A. The operation part 62A calculates the peak-to-peak voltage Vpp according to Correlation Equation (2): Vpp=f(εpc, dpc, εr, dr, T), where the peak-to-peak voltage Vpp is the objective variable, and the thickness dpc, the relative dielectric constant εpc, the thickness dr, the relative dielectric constant εr, and the temperature T are explanatory variables.

The power supply controller 63A controls the voltage controller 52A of the power supply unit 50A so that the voltage of the peak-to-peak voltage Vpp calculated by the operation part 62A is applied to the shaft 11*a* of the charging roller 11.

[Process Flow in the Image Forming Apparatus According to the Second Embodiment]

Figure 12:
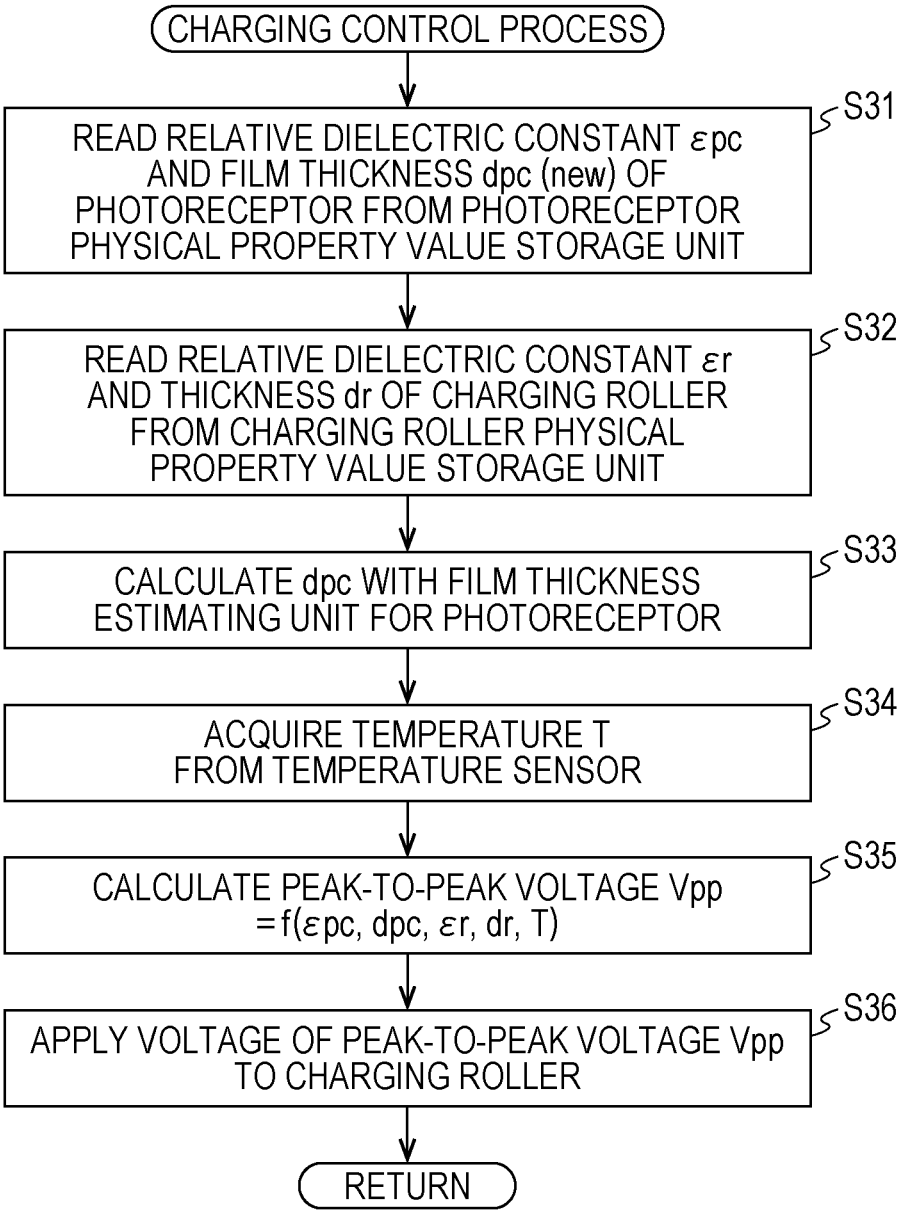
FIG. 12 is a flowchart showing the flow in a charging control process to be performed by the image forming apparatus according to the second embodiment.
Figure 13:
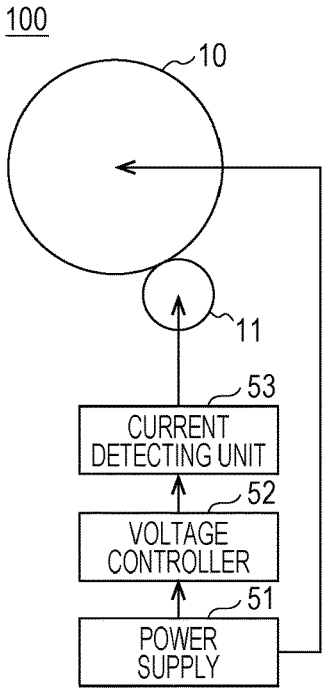
FIG. 13 is a diagram for explaining a method of electrically charging the surface of a photoreceptor with a charging roller.

Referring now to FIG. 12, the flow in a charging control process in the image forming apparatus 100A is described. FIG. 12 is a flowchart showing the flow in a charging control process to be performed by the image forming apparatus 100A according to the second embodiment.

As shown in FIG. 12, when the image forming apparatus 100A receives a printing instruction, the operation part 62A reads the relative dielectric constant εpc of the photosensitive layer 10*b* and the film thickness dpc (new) of the photosensitive layer 10*b* in an unused state from the photoreceptor physical property value storage unit 91A (step S31).

The operation part 62A then reads the thickness dr and the relative dielectric constant εr of the elastic layer 11*b* from the charging roller physical property value storage unit 92A (step S32).

The film thickness estimating unit 64 calculates the film thickness dpc from the film thickness dpc (new) of the photosensitive layer 10*b* in an unused state according to the above Equation (1), and the operation part 62A acquires the calculated film thickness dpc (step S33).

The temperature sensor 71A measures the ambient temperature T of the photoreceptor 10, and outputs the measured temperature T to the control device 60A. As a result, the operation part 62A acquires the ambient temperature T of the photoreceptor 10 (step S34).

The operation part 62A calculates the peak-to-peak voltage Vpp of the voltage to be applied to the charging roller 11, by plugging the thickness dpc, the relative dielectric constant εpc, the thickness dr, the relative dielectric constant εr, and the temperature T acquired in steps S31 through S34 into Correlation Equation (2): Vpp=f(εpc, dpc, εr, dr, T) (step S35).

The power supply controller 63A then controls the voltage controller 52A of the power supply unit 50A so that the voltage of the peak-to-peak voltage Vpp calculated in step S35 is applied to the charging roller 11. As a result, the voltage of the peak-to-peak voltage Vpp is applied to the charging roller 11 (step S36).

After that, an exposure process is performed by the exposure device 12, a developing process is performed by the developing device 13, a process of primary transfer to the intermediate transfer belt is performed, a process of secondary transfer to the paper sheet S is performed, and a fixing process is performed by the fixing device 43. Thus, the printing process is completed.

For a charging roller 11A, the peak-to-peak voltage Vpp was calculated from the relative dielectric constant εr of the charging roller 11A as in FIG. 12, and the voltage of the peak-to-peak voltage Vpp was applied to the charging roller 11A. In this case, a printing endurance test was conducted by changing the processing speed, the ambient temperature and the ambient relative humidity, and the frequency of the voltage to be applied (this frequency is referred to as the "charging frequency"). As a result, printing defects and degradation of the life of the photoreceptor 10 due to poor charging occurred as shown in Table 7, as in Table 5.

TABLE 7

| Charging roller relative dielectric constant | Processing speed | Temperature/humidity | Charging frequency (Hz) | Peak-to-peak voltage Vpp (V) | Fogging and streaks due to poor charging | Drum unit life |
|---|---|---|---|---|---|---|
| 230 | 160 | Medium temperature/ medium humidity | 1300 | 1620 | None observed | 110% |
| 230 | 80 | Medium temperature/ medium humidity | 1300 | 1620 | None observed | 95% (bad) |
| 230 | 160 | Low temperature/ low humidity | 1300 | 1620 | Observed (bad) | 110% |
| 230 | 160 | Medium temperature/ medium humidity | 2000 | 1620 | Observed (bad) | 110% |

Therefore, In accordance with the experiment results shown in FIGS. 8, 9, and 10, the peak-to-peak voltage Vpp was calculated from a value obtained by changing the relative dielectric constant in accordance with the processing speed, the temperature and the relative humidity, and the charging frequency as shown in FIG. 12, and the voltage of this peak-to-peak voltage Vpp was applied to the charging roller 11A. As a result, as in Table 6, the peak-to-peak voltage Vpp is calculated from the changed relative dielectric constant as shown in Table 8, and the calculated voltage of the peak-to-peak voltage Vpp is applied to the charging roller 11. Thus, printing defects due to poor charging can be prevented, and the life of the photoreceptor 10 can be improved.

TABLE 8

| Charging roller relative dielectric constant | Processing speed | Temperature/humidity | Charging frequency (Hz) | Peak-to-peak voltage Vpp (V) | Fogging and streaks due to poor charging | Drum unit life |
|---|---|---|---|---|---|---|
| 230 | 160 | Medium temperature/ medium humidity | 1300 | 1620 | None observed | 110% |
| 250 | 80 | Medium temperature/ medium humidity | 1300 | 1590 | None observed | 110% |
| 200 | 160 | Low temperature/ low humidity | 1300 | 1680 | None observed | 110% |
| 210 | 160 | Medium temperature/ medium humidity | 2000 | 1650 | None observed | 110% |

Table 8 shows an example of how much the relative dielectric constant is changed in a case where the processing speed, the temperature and the relative humidity, or the charging frequency is individually changed. However, in a case where these measured values are changed in combination, the relative dielectric constant is changed in accordance with the combination, so that printing defects due to poor charging can be prevented, and the life of the photoreceptor 10 can be improved.

In the second embodiment, the film thickness estimating unit 64 functions as a film thickness acquiring unit by estimating the current thickness dpc of the photosensitive layer 10*b* of the photoreceptor 10. However, the present invention is not limited to this, and the sensors 70A may include a film thickness sensor. In such a case, the film thickness sensor may function as a film thickness acquiring unit.

The film thickness sensor 73 detects the thickness dpc of the photosensitive layer 10*b* of the photoreceptor 10. The film thickness sensor emits light onto the surface of the photoreceptor 10, for example, and detects the thickness of the photosensitive layer 10*b* in accordance with the phase difference between the light reflected from the surface of the photosensitive layer 10*b* and the light reflected from the interface between the photosensitive layer 10*b* and the substrate 10*a*. For example, MPOR-FP manufactured by Fischer Instruments K. K. can be used as the film thickness sensor. The film thickness sensor measures the thickness dpc of the photosensitive layer 10*b*, and outputs the thickness dpc to the control device 60A. As a result, the operation part 62A acquires the thickness dpc of the photosensitive layer 10*b*.

In the above description, the correlation equation, Vpp=f (εpc, dpc, εr, dr, dr, T) is used. However, the number of explanatory variables is not necessarily the same as that in the correlation equation. For example, in a case where the production tolerance of the thickness of the elastic layer 11*b* of the charging roller 11 is small, the thickness dr may be excluded.

Further, instead of the relative dielectric constant εpc, the dielectric constant of the photosensitive layer 10*b*, which is obtained by multiplying the relative dielectric constant εpc by the dielectric constant of vacuum, may be used as a physical property value of the photoreceptor 10. Likewise, instead of the relative dielectric constant εr, the dielectric constant of the elastic layer 11*b*, which is obtained by multiplying the relative dielectric constant εr by the dielectric constant of vacuum, may be used as a physical property value of the charging roller 11.

[Effects]

(1) As described above and as shown in FIGS. 4, 6, 11, and 12, the image forming apparatus 100 (100A) in the present disclosure includes: the photoreceptor 10 having the photosensitive layer 10*b* formed on its surface; the charging roller 11 that electrically charges the surface of the photoreceptor 10 through electric discharge between the charging roller 11 and the photoreceptor 10; the operation part 62 (62A) that calculates the peak-to-peak voltage Vpp to be applied to the charging roller 11 from the measured value εr of the relative dielectric constant of the charging roller 11 measured in advance; and the power supply controller 63

(63A) that controls the voltage to be applied to the charging roller 11, to apply the peak-to-peak voltage Vpp calculated by the operation part 62 (62A) to the charging roller 11. With this configuration, printing defects due to poor charging can be prevented, and the life of the photoreceptor can be improved.

(2) In the above (1), the operation part 62 (62A) calculates the peak-to-peak voltage Vpp from the value of a relative dielectric constant obtained by changing the measured value in accordance with the value of an index that affects the relative dielectric constant εr.

(3) In the above (2), the index is the frequency of the voltage to be applied to the charging roller 11, or the circumferential velocity (processing speed) of the photoreceptor 10. When the index is made greater than a predetermined reference value, the operation part 62 (62A) calculates the peak-to-peak voltage Vpp from the value of the relative dielectric constant made lower than the measured value, so that the peak-to-peak voltage Vpp becomes higher than the value corresponding to the measured value.

(4) In the above (2), the index is the ambient temperature T of the charging roller 11 or the ambient relative humidity of the charging roller 11. When the index is made greater than a predetermined reference value, the operation part 62 (62A) calculates the peak-to-peak voltage Vpp from the value of the relative dielectric constant made higher than the measured value, so that the peak-to-peak voltage Vpp becomes lower than the value corresponding to the measured value.

(5) In the above (1) through (4), the operation part 62 (62A) calculates the peak-to-peak voltage Vpp when the photoreceptor 10 and the charging roller 11 are driven.

(6) In the above (1) through (5), the charging roller 11 can be replaced with another charging roller 11, and the measured value εr varies depending on each charging roller 11. The image forming apparatus 100 (100A) further includes the information acquiring unit 61 (61A) that determines the measured values εr. The operation part 62 (62A) calculates the peak-to-peak voltage Vpp from the measured value εr determined by the information acquiring unit 61 (61A).

(7) A control method in the present disclosure is a method of controlling the image forming apparatus 100 (100A). As shown in FIGS. 4 and 11, the image forming apparatus 100 (100A) includes: the photoreceptor 10 having the photosensitive layer 10*b* formed on its surface; the charging roller 11 that electrically charges the surface of the photoreceptor 10 through electric discharge between the charging roller 11 and the photoreceptor 10; and the control device 60 (60A) that controls the respective parts of the image forming apparatus 100 (100A). As shown in FIGS. 6 and 12, the control method includes the step of calculating the peak-to-peak voltage Vpp to be applied to the charging roller 11 from a measured value εr of the relative dielectric constant of the charging roller 11 measured in advance; and the step of controlling the voltage to be applied to the charging roller 11, to apply the calculated peak-to-peak voltage Vpp to the charging roller 11. These steps are to be carried out by the control device 60 (60A). With this configuration, printing defects due to poor charging can be prevented, and the life of the photoreceptor can be improved.

Although embodiments of the present invention have been described and illustrated in detail, the disclosed embodiments are made for purposes of illustration and example only and not limitation. The scope of the present invention should be interpreted by terms of the appended claims, and it should be understood that equivalents of the claimed inventions and all modifications thereof are incorporated herein.

What is claimed is:

1. An image forming apparatus comprising:

a photoreceptor having a photosensitive layer formed on a surface;

a charging device that electrically charges the surface of the photoreceptor through electric discharge between the charging device and the photoreceptor; and a hardware processor that:

calculates a peak-to-peak voltage to be applied to the charging device, using a measured value of a relative dielectric constant of the charging device, the relative dielectric constant having been measured in advance; and controls a voltage to be applied to the charging device, to apply the peak-to-peak voltage calculated by the hardware processor to the charging device.

2. The image forming apparatus according to claim 1, wherein the hardware processor calculates the peak-to-peak voltage, using a value of a relative dielectric constant obtained by changing the measured value in accordance with a value of an index that affects the relative dielectric constant.

3. The image forming apparatus according to claim 2, wherein the index is a frequency of the voltage to be applied to the charging device.

4. The image forming apparatus according to claim 3, wherein, when the index is greater than a predetermined reference value, the hardware processor calculates the peak-to-peak voltage Vpp from a value of the relative dielectric constant made lower than the measured value, to make the peak-to-peak voltage Vpp higher than a value corresponding to the measured value.

5. The image forming apparatus according to claim 2, wherein the index is a circumferential velocity of the photoreceptor.

6. The image forming apparatus according to claim 2, wherein the index is an ambient temperature of the charging device.

7. The image forming apparatus according to claim 6, wherein, when the index is greater than a predetermined reference value, the hardware processor calculates the peak-to-peak voltage Vpp from a value of the relative dielectric constant made higher than the measured value, to make the peak-to-peak voltage Vpp lower than a value corresponding to the measured value.

8. The image forming apparatus according to claim 2, wherein the index is an ambient relative humidity of the charging device.

9. The image forming apparatus according to claim 1, wherein the hardware processor calculates the peak-to-peak voltage when the photoreceptor and the charging device are driven.

10. The image forming apparatus according to claim 1, wherein the charging device can be replaced with another charging device, the measured value varies depending on each charging device, the image forming apparatus further comprises a determiner that determines the measured value, and the hardware processor calculates the peak-to-peak voltage, using the measured value determined by the determiner.

11. A control method for controlling an image forming apparatus, the image forming apparatus including:

a photoreceptor having a photosensitive layer formed on a surface;

a charging device that electrically charges the surface of the photoreceptor through electric discharge between the charging device and the photoreceptor; and a hardware processor that controls respective parts of the image forming apparatus, the control method comprising:

calculating a peak-to-peak voltage to be applied to the charging device, using a measured value of a relative dielectric constant of the charging device, the relative dielectric constant having been measured in advance, the calculating being performed by the hardware processor; and controlling a voltage to be applied to the charging device, to apply the calculated peak-to-peak voltage to the charging device, the controlling being performed by the hardware processor.

* * * * *